US010267186B2

(12) United States Patent
Sebald et al.

(10) Patent No.: US 10,267,186 B2
(45) Date of Patent: Apr. 23, 2019

(54) CAMSHAFT ADJUSTER

(71) Applicant: Schaeffler Technologies AG & Co. KG, Herzogenaurach (DE)

(72) Inventors: Stefan Sebald, Waischenfeld (DE); Stefan Hoelzel, Obertrubach (DE); Boris Puetz, Fuerth (DE); Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 95 days.

(21) Appl. No.: 15/304,296

(22) PCT Filed: Apr. 2, 2015

(86) PCT No.: PCT/DE2015/200245
§ 371 (c)(1),
(2) Date: Oct. 14, 2016

(87) PCT Pub. No.: WO2015/158345
PCT Pub. Date: Oct. 22, 2015

(65) Prior Publication Data

US 2017/0037748 A1 Feb. 9, 2017

(30) Foreign Application Priority Data

Apr. 17, 2014 (DE) ..... 10 2014 207 401

(51) Int. Cl.
*F01L 1/344* (2006.01)

(52) U.S. Cl.
CPC ... *F01L 1/3442* (2013.01); *F01L 2001/34433* (2013.01); *F01L 2001/34453* (2013.01); *F01L 2001/34483* (2013.01)

(58) Field of Classification Search
CPC ..... F01L 2001/34483
USPC ..... 123/90.17, 90.67
See application file for complete search history.

(56) References Cited

U.S. PATENT DOCUMENTS

| | | | | |
|---|---|---|---|---|
| 6,758,178 | B2 | 7/2004 | Takahashi et al. | |
| 6,769,386 | B2 | 8/2004 | Shafer et al. | |
| 7,165,521 | B2 | 1/2007 | Nakajima | |
| 8,191,521 | B2 | 6/2012 | Kandolf et al. | |
| 8,640,334 | B2 | 2/2014 | Vukovich et al. | |
| 8,851,033 | B2 | 10/2014 | Janitschek et al. | |
| 9,200,542 | B2 | 12/2015 | Weber et al. | |
| 2002/0152977 | A1 | 10/2002 | Eguchi et al. | |
| 2009/0069097 | A1* | 3/2009 | Fischer | F01L 1/3442 464/1 |

(Continued)

FOREIGN PATENT DOCUMENTS

| | | |
|---|---|---|
| CN | 102840004 | 12/2012 |
| DE | 10361509 | 7/2004 |

(Continued)

*Primary Examiner* — Jorge Leon, Jr.
(74) *Attorney, Agent, or Firm* — Davidson, Davidson & Kappel, LLC

(57) ABSTRACT

A camshaft adjuster (1) including a stator (2) and a rotor (4), a spring (6) tenses the rotor (4) rotationally counter to the stator (2). According to the invention, the spring is a coil spring (6), the stator (2) includes a first recess (8) of a first free end (10) of the coil spring (6) and the rotor (4) includes a second recess (12) for a second free end (14) of the coil spring (6).

9 Claims, 6 Drawing Sheets

(56) References Cited

U.S. PATENT DOCUMENTS

| | | | | |
|---|---|---|---|---|
| 2009/0188456 | A1* | 7/2009 | Dupuis | F01L 1/3442 123/90.17 |
| 2010/0064996 | A1* | 3/2010 | Lichti | F01L 1/3442 123/90.17 |
| 2010/0199937 | A1* | 8/2010 | Fujiyoshi | F01L 1/3442 123/90.17 |
| 2012/0174884 | A1* | 7/2012 | Shinomiya | F01L 1/3442 123/90.15 |
| 2013/0036993 | A1* | 2/2013 | Nakamura | F01L 1/3442 123/90.15 |
| 2013/0233263 | A1* | 9/2013 | Kinouchi | F01L 1/3442 123/90.17 |
| 2013/0276735 | A1 | 10/2013 | Schulte et al. | |
| 2013/0324269 | A1* | 12/2013 | Janitschek | F01L 1/3442 464/160 |
| 2014/0069361 | A1* | 3/2014 | Watanabe | F01L 1/053 123/90.15 |
| 2014/0202405 | A1* | 7/2014 | Shinomiya | F01L 1/34409 123/90.15 |
| 2015/0361837 | A1* | 12/2015 | Sugano | F01L 1/3442 123/90.15 |

FOREIGN PATENT DOCUMENTS

| | | | | |
|---|---|---|---|---|
| DE | 102010015174 | | 10/2011 | |
| DE | 102012206567 | | 4/2012 | |
| DE | 102010063706 | | 6/2012 | |
| EP | 1895113 | | 3/2008 | |
| JP | H11173118 | | 6/1999 | |
| JP | 2000161027 | | 6/2000 | |
| JP | WO 2014112456 | A1 * | 7/2014 | F01L 1/3442 |
| WO | WO00144628 | | 6/2001 | |

* cited by examiner

CAMSHAFT ADJUSTER

The present invention relates to a camshaft adjuster which includes a stator and a rotor, a spring rotatably bracing the rotor against the stator.

BACKGROUND

It is generally known that camshaft adjusters are used in internal combustion engines for varying the timing of the combustion chamber valves. Adjusting the timing to the instantaneous load reduces fuel consumption and emissions. Camshaft adjusters include a stator and a rotor. The rotor is usually connected in a rotatably fixed manner to the camshaft, the rotor being situated within the stator, coaxially with respect to same. The rotor and stator include oil chambers which may be acted on by oil pressure and generate a relative movement between the stator and the rotor.

To allow a torque transmission between the components of rotor and stator and also to compensate for a drive torque of the camshaft, a spring rotatably braces the rotor against the stator. This is described, for example, in German patent specification DE 103 61 509 B4 or United States patent specification U.S. Pat. No. 6,758,178 B2. In the cited publications, a coil spring is supported on each rotor by additional components or additional machining of the rotor. These additional parts or the additional machining increase not only the manufacturing costs, but also the assembly costs of a camshaft adjuster. In addition, the installation space for the coil spring is limited in the camshaft adjuster. However, since these known spring bearings require a relatively long axial installation length, installation of the coil spring in the rotor is therefore made more difficult.

In addition, it is generally known and customary in the prior art for these camshaft adjusters to include a cover that is situated on both sides of the "stator-rotor assembly." These covers may have further functions in addition to a strictly sealing function. Thus, for example, they may be designed with gear teeth or with locking elements in order to be used as a chain wheel or as a locking cover. Regardless of which specific embodiment the cover includes, it is always designed in one piece. It is also known to fasten the above-described spring to the cover in order to brace the rotor against the stator.

For camshaft adjusters which provide a spring in the form of a coil spring, the coil spring is suspended in the cover and then fixed. For this purpose, a collar for spring suspension is necessary in the inner diameter of the cover. Due to the spring torque, the torsion spring in the spring suspension, which is formed as a punched or milled undercut (forming a web), is pressed against the cover collar, or axially and radially secured in a pressed-in pin. These known approaches using a cover with a drawn collar also have a number of disadvantages.

SUMMARY OF THE INVENTION

If the installation space in the overall camshaft adjuster is very small, and the punched spring suspension has too small a cross section, during operation of a camshaft adjuster this may result in failure due to a rupture of the web.

In addition, the sheet metal fibers of the cover are severed at three sides due to the punched-out or milled spring suspension. As a result, the stability of the remaining web of the spring suspension in the circumferential direction is less than in a specific embodiment which is only shaped, or punched out or bent upwardly, at fewer than three sides.

It has also been shown in practice that during the punching, a cutting gap is necessary between the base of the cover and the collar. Depending on the geometric design with an excessively large material cross section on the collar, the cutting punch must also have a certain cross section in order to still allow cost-effective manufacture. For this reason, the punch generally has a square design. This means that for a radial collar thickness of 3 mm, for example, the cutting punch as well must be at least 3 mm wide. The suspended spring thus has more play on the cover than is necessary or allowed.

Furthermore, a cutting force must be supported on the remaining web during the punching. The cutting force is thus determined by geometric or material limits of counterholders. For very small installation space conditions, this may be a reason for not being able to implement some spring designs.

In particular, the grindability of such drawn covers is limited or is not economically viable. Due to the large differences in surface area between the cover area and the narrow collar area, grinding removal with high asymmetry is to be expected. In addition, an option for turning the cover area is not always the best choice from a cost-effectiveness and qualitative standpoint, for example due to chatter marks from interrupted cuts, insufficiently large clamping surfaces for tools, or too precise requirements for squareness.

It is an object of the present invention to refine a camshaft adjuster in such a way that it compensates for a drive torque of the camshaft in a cost-effective and space-saving way, and during operation meets technical and mechanical requirements in a functionally reliable way.

The camshaft adjuster according to the present invention is made up of a stator and a rotor. A spring rotatably braces the rotor against the stator, so that during operation of the camshaft adjuster a drive torque of the camshaft may be at least partially compensated for.

According to the present invention, the spring is a coil spring, for which the stator has a first recess for a first free end of the coil spring, and the rotor has a second recess for a second free end of the coil spring.

In a first specific embodiment of the camshaft adjuster according to the present invention, a polygon, for example a square, forms the second recess at an inner wall of the rotor, with which a correspondingly shaped spring winding of the second free end of the coil spring cooperates in a form-fit manner. In particular, a last spring winding of the coil spring is appropriately shaped to ensure the required form fit. If the coil spring is thus inserted into the base, i.e., into the inner wall, of the rotor, a rotatably fixed connection is established between the second free end of the coil spring and the rotor.

Another specific embodiment provides that a width across flats of the polygon in the rotor is designed to be small enough that the polygon is situated beneath a screw head of a screw which fastens at least one cover to the stator. The second free end of the coil spring is axially held in position in this way.

In a second specific embodiment of the present invention, a borehole is provided in the rotor. The borehole is situated at an angle less than or equal to 90° with respect to the pulling direction of the coil spring in the rotor, and represents the second recess into which the second free end of the coil spring is inserted. This specific embodiment generates an axial force in a self-acting manner which automatically forces the second free end of the coil spring into the installation position.

In particular, the camshaft adjuster provides at least one cover in order to prevent oil within the camshaft adjuster from escaping. The at least one cover is mounted on the stator via at least one screw.

One specific embodiment of the present invention provides that a metal sheet is mounted on the stator via the at least one screw, and which has formed an axial bulge which forms the first recess, and in which the first free end of the coil spring rests. To prevent the first free end of the coil spring from falling out of the axial bulge, a partially cut-out element, such as a window, is additionally provided on the metal sheet or cover. This specific embodiment functions as a bayonet lock for the second free end of the coil spring. In particular, another specific embodiment may be provided here, in which the metal sheet is designed in such a way that in addition to this axial fixing of the first free end of the coil spring, further spring windings of the coil spring may be axially held in position. The coil spring is thus prevented from falling out.

In another specific embodiment of the camshaft adjuster according to the present invention, the at least one screw forms an extended screw head or screw shank for the first recess, in which the first free end of the coil spring is suspended.

Another specific embodiment provides that the at least one cover forms an axial extension element for the first recess, in which the first free end of the coil spring is suspended. In this specific embodiment, for example a press-in part, which is necessary on the inner side of the cover for mechanical locking of the camshaft adjuster, is appropriately modified on the outer side to form an axial extension element.

In another preferred specific embodiment, the at least one cover is made up of an inner cover and an outer cover. The inner cover is a sealing cover for preventing oil within the camshaft adjuster from escaping. The outer cover forms a spring recess cover for the first recess, in which the first free end of the coil spring is suspended. In the present invention, instead of a cover with a drawn collar, two covers are thus used as a "package" in this specific embodiment, in contrast to the prior art. The strength or rigidity of the spring recess cover is thus advantageously increased, which as a whole ensures the functioning of the overall camshaft adjuster under all operating conditions. The sealing cover preferably includes at least one ground sealing surface as a contact surface for the "stator-rotor assembly." The coil spring suspension is introduced into the spring recess cover as an axially punched or shaped spring suspension. This spring recess cover may provide various specific embodiments for the first recess of the first free end of the coil spring, such as a cutout, an elevated element, an upwardly bent element, a free punched out portion, or a combination thereof.

In particular, in one specific embodiment the spring recess cover may be designed in the form of a stamped closed ring; in another specific embodiment it is likewise conceivable for the spring recess cover to be at least a partial segment of a ring.

In addition, it is noted here that the inner diameter of the spring recess cover may be designed as described below. On the one hand, the inner diameter may be smaller than an outer diameter of the coil spring, thus achieving additional axial spring lock. On the other hand, the inner diameter may be greater than or equal to the outer diameter of the coil spring. This larger area may then be used as an additional spring work area. However, guiding of the coil spring is not possible then.

All of the above-described specific embodiments of the coil spring on the rotor and/or on the stator or on the at least one cover may be arbitrarily combined with one another, provided that the coil spring rotatably braces the rotor against the stator. It is likewise conceivable for spring suspensions on the rotor or on the stator, already known from the prior art, to be combinable with the above specific embodiments of the present invention.

BRIEF DESCRIPTION OF THE DRAWINGS

Exemplary embodiments of the present invention and their advantages are explained in greater detail below with reference to the appended figures. For the sake of clarity, the shapes in the figures are simplified and are not always illustrated true to scale.

DETAILED DESCRIPTION

Figure 1A:
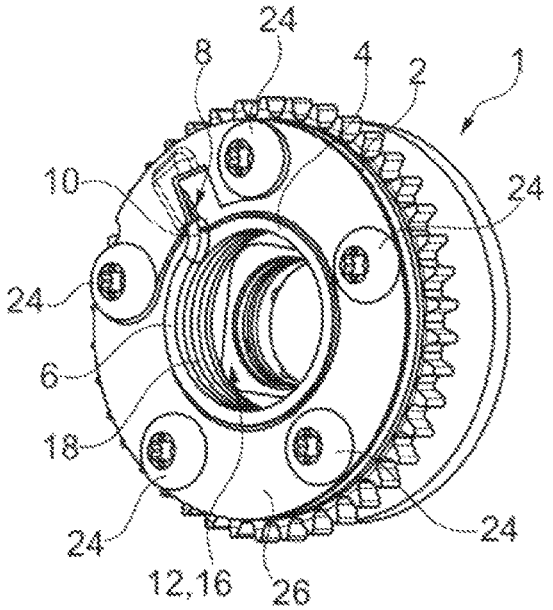
FIGS. 1A and 1B show a perspective view and a cross-sectional view of a first specific embodiment of the camshaft adjuster according to the present invention, in which a second free end of a coil spring cooperates with a second recess on the rotor.

Identical reference numerals are used for similar or functionally equivalent elements of the present invention. In addition, for the sake of clarity, only reference numerals are illustrated in the individual figures that are necessary for describing the particular figure. The illustrated specific embodiments are used only to illustrate the camshaft adjuster according to the present invention by way of example, but are not to be construed as limiting the present invention.

Figure 1B:
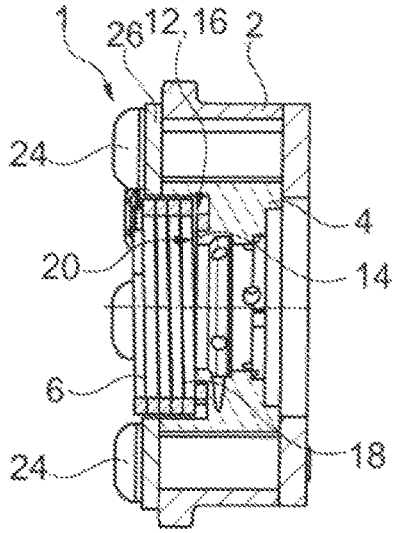

FIG. 1A shows a perspective view and FIG. 1B shows a cross-sectional view of a first specific embodiment of camshaft adjuster 1 according to the present invention, which is made up of a stator 2 and a rotor 4. A spring in the form of a coil spring 6 rotatably braces rotor 4 against stator 2, so that a drive torque of a camshaft, not illustrated here, may be compensated for during operation of camshaft adjuster 1. According to the present invention, stator 2 includes a first recess 8 for a first free end 10 of coil spring 6, and rotor 4 includes a second recess 12 for a second free end 14 of coil spring 6.

Figure 3A:
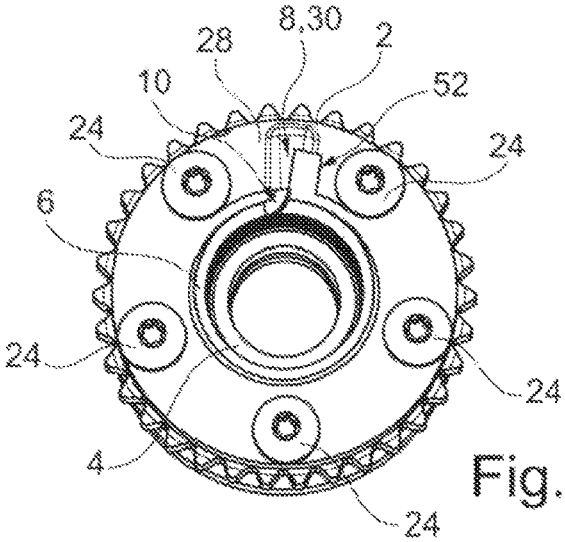
FIGS. 3A and 3B show a perspective view and a cross-sectional view of a first specific embodiment of the present invention, in which a first free end of the coil spring rests in a first recess on the stator.
Figure 3B:
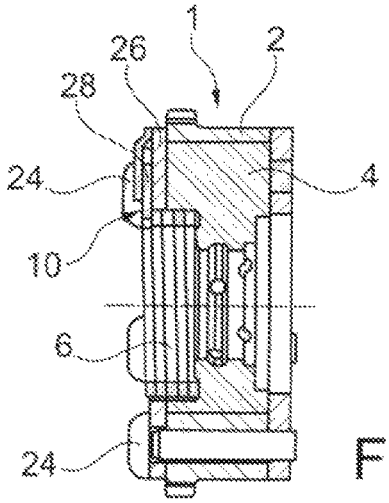

In FIGS. 1A and 1B, only the specific embodiment is described in which second free end 14 of coil spring 6 cooperates with second recess 12 of rotor 4. The description for FIGS. 3A and 3B is to be used for the specific embodiment of first recess 8 of first free end 10 of coil spring 6 on stator 2.

A square 16 at an inner wall 18 of rotor 4 forms second recess 12, with which a correspondingly shaped spring winding 20 of second free end 14 of coil spring 6 cooperates in a form-fit manner. In particular, a last spring winding 20 of coil spring 6 has a corresponding angular or right-angled shape. When coil spring 6 is thus inserted into inner wall 18 of rotor 4, a rotatably fixed connection is established between second free end 14 of coil spring 6 and rotor 4. According to one specific embodiment of the present invention, a form-fit and rotatably fixed connection is established between coil spring 6 and rotor 4.

Figure 1C:
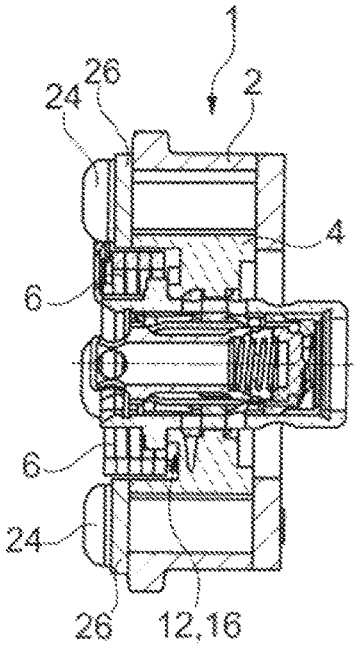
FIG. 1C shows a cross-sectional view of one refinement of the specific embodiment from FIGS. 1A and 1B.

FIG. 1C shows a cross-sectional view of one refinement of the first specific embodiment from FIGS. 1A and 1B, in which a width across flats of square 16 is designed to be small enough that square 16 is situated beneath a screw head of a screw 24 which fastens a cover 26 to stator 2. Second free end 14 of coil spring 6 is axially held in position in this way.

Figure 2:
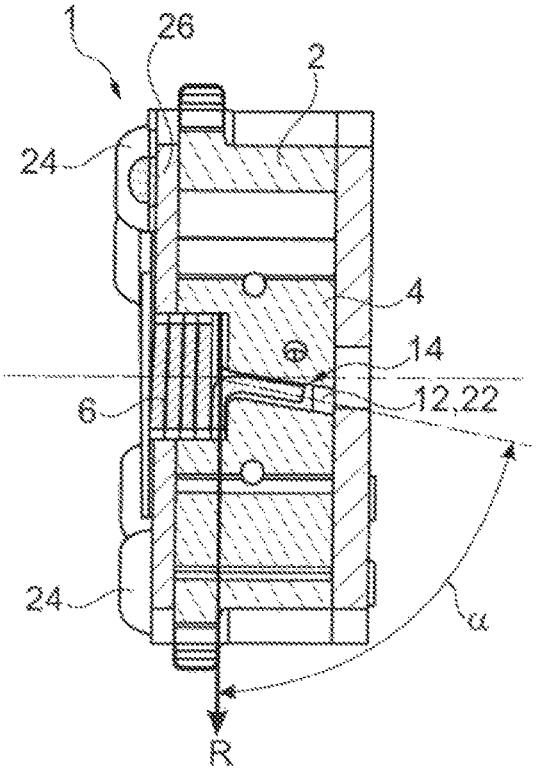
FIG. 2 shows a cross-sectional view of a second specific embodiment of the present invention, in which the second free end of the coil spring is introduced into the second recess on the rotor.

FIG. 2 shows a cross-sectional view of a second specific embodiment of the present invention. A borehole 22 forms second recess 12 at an angle $\alpha$ less than 90° with respect to pulling direction R of coil spring 6 in rotor 4, into which second free end 14 of coil spring 6 is introduced. This specific embodiment generates an axial force in a self-acting manner which automatically forces second free end 14 of coil spring 6 into the installation position.

FIG. 3A shows a perspective view and FIG. 3B shows a cross-sectional view of a first specific embodiment of the present invention, in which a first free end 10 of coil spring 6 rests in a first recess 8 in stator 2. For this purpose, camshaft adjuster 1 provides an additional metal sheet 28 which is mounted on stator 2 via at least two screws 24, and which has formed an axial bulge 30 which forms first recess 8, and in which first free end 10 of coil spring 6 rests. A partially cut-out element 52 is additionally provided on stator 2 to facilitate insertion of first free end 10 of coil spring 6 into axial bulge 30.

Figure 4:
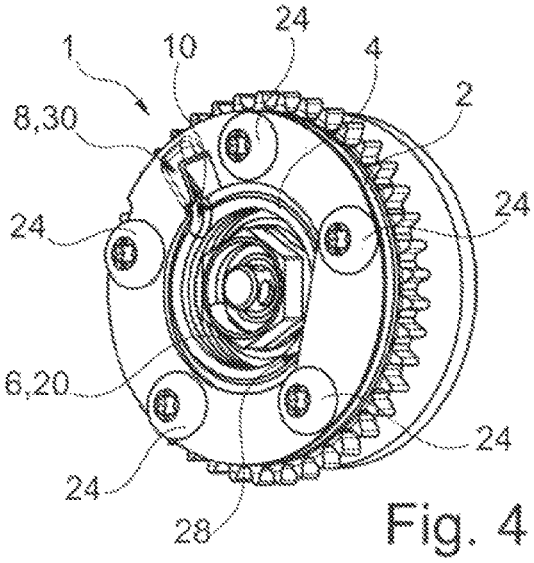
FIG. 4 shows a perspective view of one refinement of the specific embodiment from FIGS. 3A and 3B.

FIG. 4 shows a perspective view of one refinement of the specific embodiment from FIGS. 3A and 3B. Here, metal sheet 28 is designed in such a way that in addition to this axial fixing of first free end 10 of coil spring 6, further spring windings 20 of coil spring 6 are axially held in position. Coil spring 6 is thus prevented from falling out.

Figure 5A:
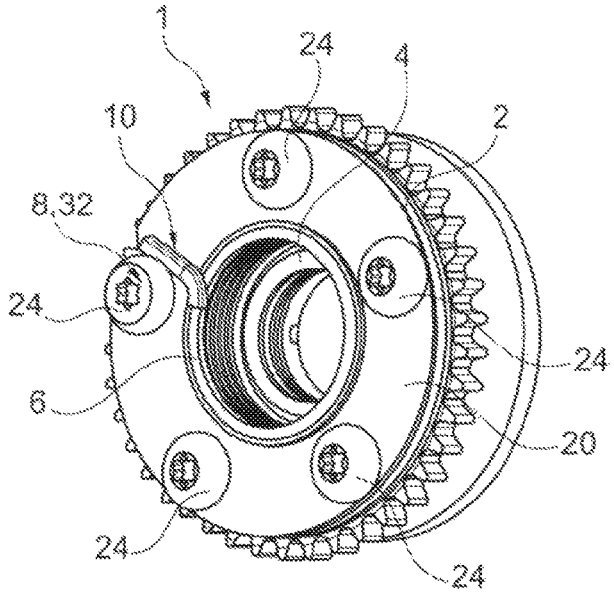
FIGS. 5A and 5B show a perspective view and a cross-sectional view of another specific embodiment of the present invention, in which the first free end of the coil spring is suspended in the first recess on the stator.
Figure 5B:
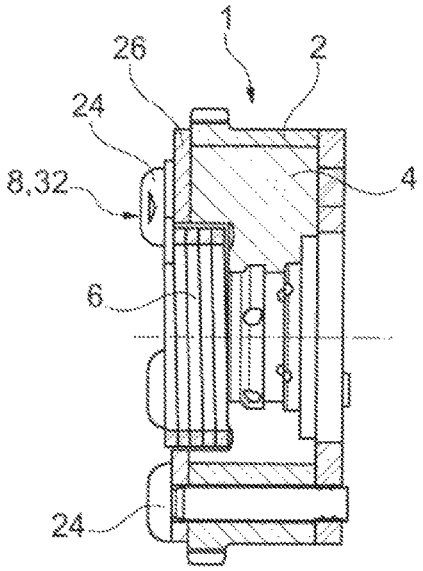

FIG. 5A shows a perspective view and FIG. 5B shows a cross-sectional view of another specific embodiment of the present invention, in which first free end 10 of coil spring 6 is suspended in first recess 8 in stator 2, in particular in such a way that at least one screw 24 forms an extended screw head 32 for first recess 8.

Figure 6A:
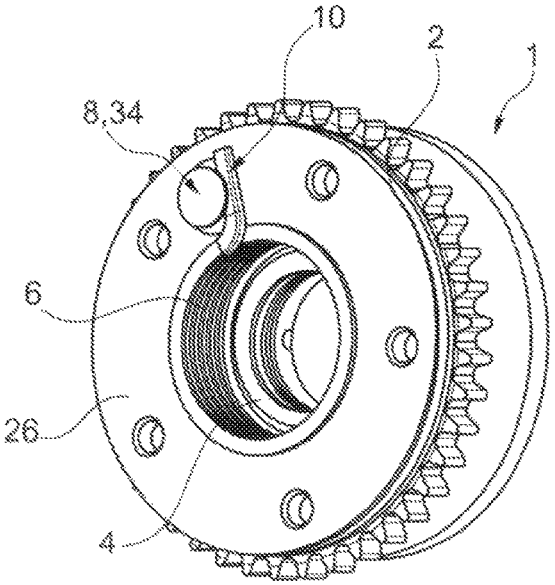
FIGS. 6A and 6B show another perspective view and a cross-sectional view of another specific embodiment of the present invention, in which the first free end of the coil spring is suspended in the first recess on the stator.
Figure 6B:
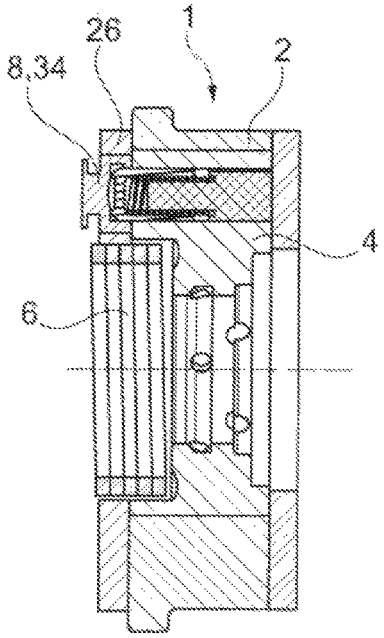

FIG. 6A shows a perspective view and FIG. 6B shows a cross-sectional view of another specific embodiment of the present invention, in which cover 26 forms an axial extension element 34 for first recess 8, in which first free end 10 of coil spring 6 is suspended. Axial extension element 34 has a T-shaped design.

Figure 7:
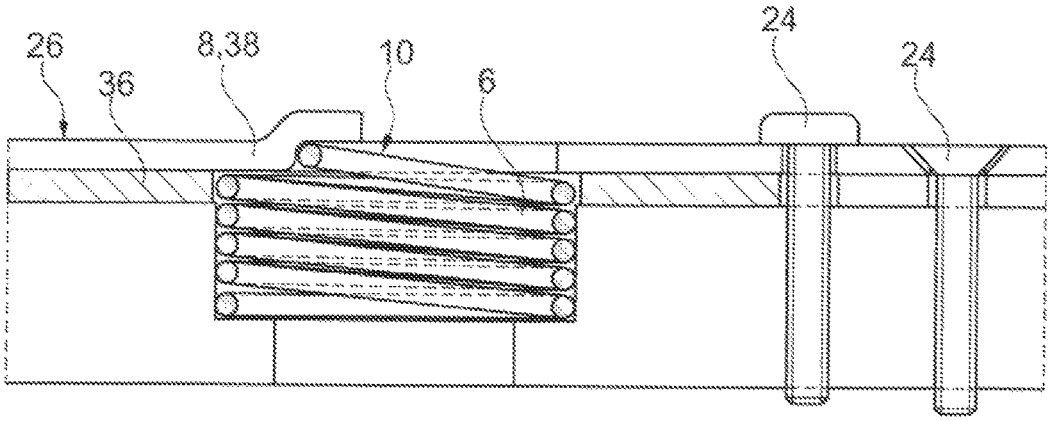
FIG. 7 shows a cross-sectional view of a cover of the camshaft adjuster according to the present invention, which is made up of an inner cover and an outer cover.

FIG. 7 shows a cross-sectional view of a cover 26 of camshaft adjuster 1 according to the present invention, which is made up of an inner cover 36 and an outer cover 38. The inner cover is a sealing cover 36, and the outer cover forms a spring recess cover 38 for first recess 8, in which first free end 10 of coil spring 6 is suspended. This illustration of the screwing direction shows the screwing direction from the side of sealing cover 36 and of spring recess cover 38. Alternatively, a screwing direction is also possible in which the thread in spring recess cover 38 is implemented in the form of cut threads or via press-in nuts.

Detailed specific embodiments of the design of spring recess cover 38 are apparent from FIGS. 9A through 9F and are described with reference to same.

Figure 8A:
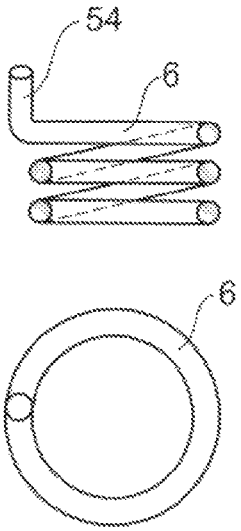
FIGS. 8A, 8B, and 8C each show a side view and a top view of known coil springs that are used in the present invention for subsequent FIGS. 9A through 9F.
Figure 8B:
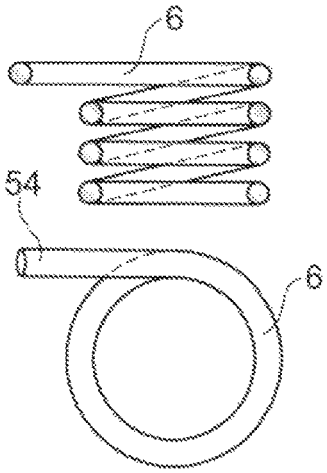
Figure 8C:
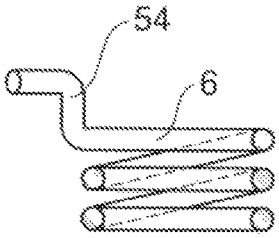

FIGS. 8A, 8B, and 8C each show a side view and a top view of known coil springs 6 used in the present invention for subsequent FIGS. 9A through 9F.

In FIG. 8A, coil spring 6 is designed in such a way that it includes an axial leg 54. Coil spring 6 in FIG. 8B is designed in such a way that it has formed a radial leg 54. In contrast, in FIG. 8C, coil spring 6 is formed from a combination from FIGS. 8A and 8B; i.e., coil spring 6 includes a leg 54 which is both axial and radial.

FIGS. 9A through 9F each show a top view and a side view of specific embodiments of cover 26 according to FIG. 7, in which the outer cover is a spring recess cover 38, and first free end 10 of coil spring 6 is suspended therein. The leadthroughs or threads for fastening are not illustrated for the sake of simplicity.

Figure 9A:
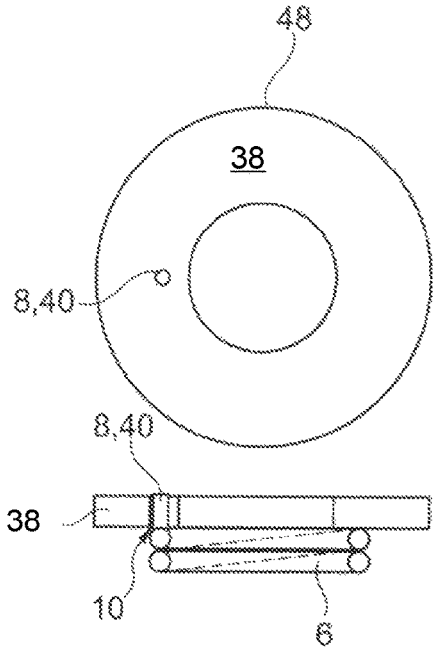
FIGS. 9A through 9F each show a top view and a side view of specific embodiments of the cover according to FIG. 7, in which the outer cover is a spring recess cover, and the first free end of the coil spring cooperates with same.

In FIG. 9A, spring recess cover 38 for first recess 8 of first free end 10 of coil spring 6 has a cutout 40 in the form of a hole. The inner diameter of spring recess cover 38 here is preferably smaller than an outer diameter of coil spring 6, so that an additional axial spring lock is achieved. In addition, in this specific embodiment a coil spring 6 which includes an axial leg 54 according to FIG. 8A is preferably used.

Figure 9B:
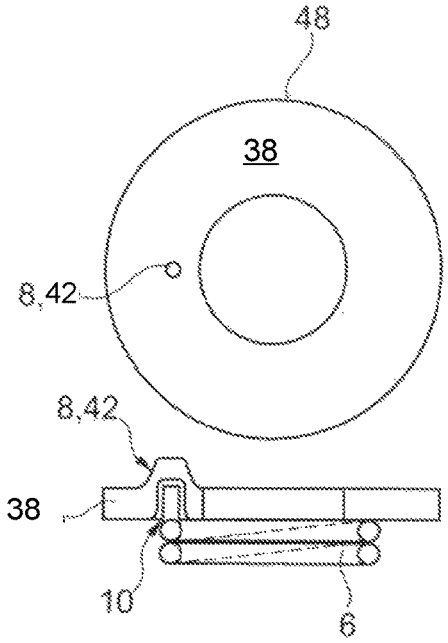

Spring recess cover 38 in FIG. 9B has formed an elevated element 42, i.e., an elevated slot, in which first free end 10 of coil spring 6 is suspended. The inner diameter of axial spring retainer and the selection of coil spring 6 correspond to FIG. 9A.

Figure 9C:
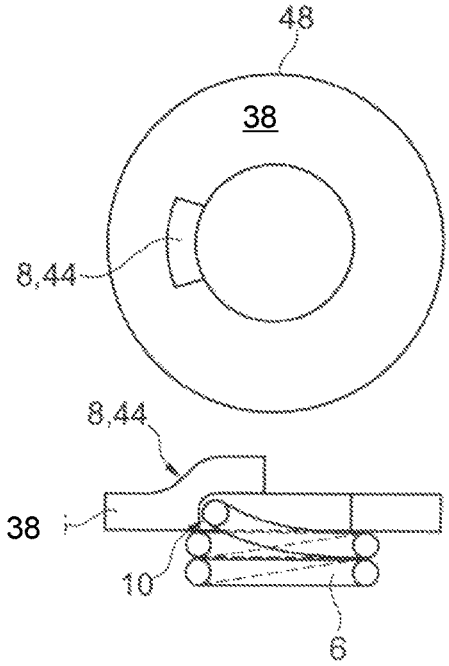

In FIG. 9C, spring recess cover 38 for first recess 8 of first free end 10 of coil spring 6 includes an upwardly bent element 44, such as an upwardly bent tab shown here. A coil spring 6 which includes a radial leg 54 according to FIG. 8*b* is preferably used in this specific embodiment. The axial spring lock is preferably achieved here only via upwardly bent element 44. However, it is also conceivable to reinforce the axial spring lock by using a coil spring 6 which includes an axial and radial leg 54 according to FIG. 8C.

Figure 9D:
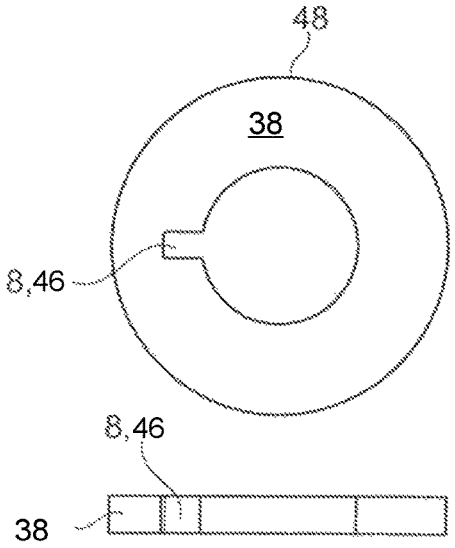

Spring recess cover 38 in FIG. 9D has a free punched out portion 46 for first recess 8 of first free end 10 of coil spring 6 (not illustrated here). In this specific embodiment, coil spring 6 once again is a coil spring 6 which includes a radial leg 54 according to FIG. 8*b*. An axial spring lock is not necessary in this specific embodiment.

Figure 9E:
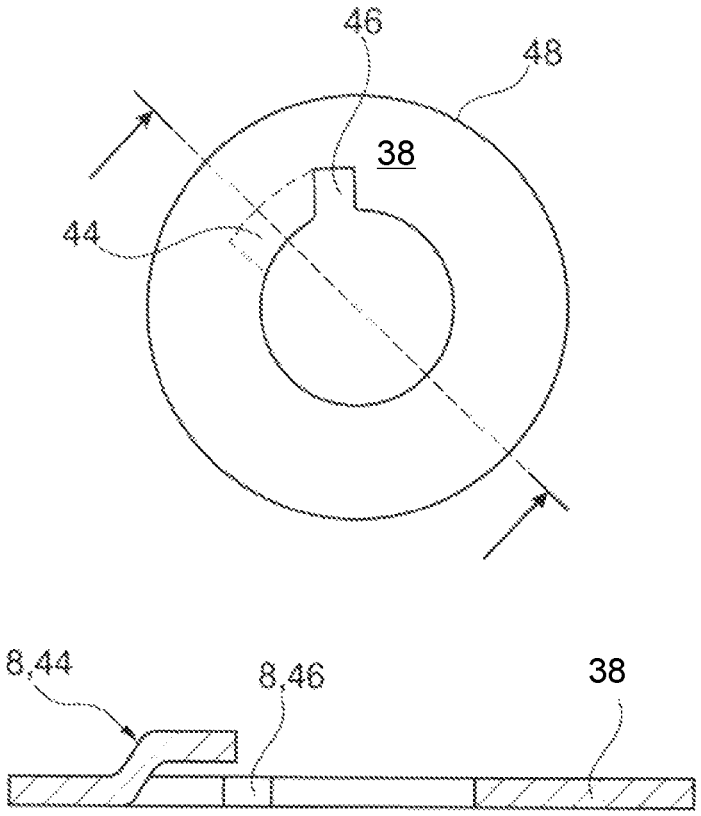

In FIG. 9E, spring recess cover 38 for first recess 8 of first free end 10 of coil spring 6 (not illustrated here) includes, in addition to a free punched out portion 46 already described with reference to FIG. 9D, an upwardly bent element 44 according to FIG. 9C. Other combinations of the above-described specific embodiments of spring recess cover 38 for first recess 8 of first free end 10 of coil spring 6 are also conceivable.

Figure 9F:
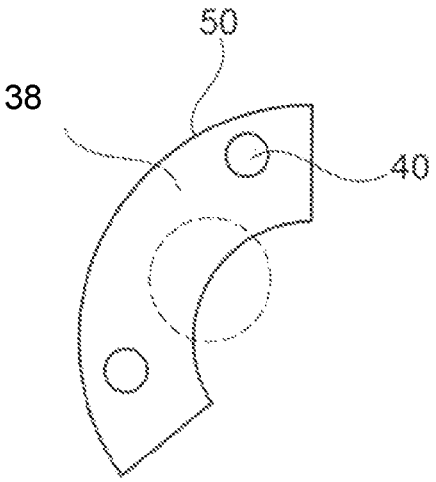

In FIGS. 9A through 9E, spring recess cover 38 is a stamped closed ring 48. However, as shown in FIG. 9F, it is also conceivable for spring recess cover 38 to merely be at least a partial segment 50 of a ring 48 (see FIGS. 9A through 9E), which likewise has a cutout 40 for first recess 8 of first free end 10 of coil spring 6. However, it is also conceivable for partial segment 50 to include an elevated element 42, an upwardly bent element 44, a free punched out portion 46, or a combination thereof.

LIST OR REFERENCE NUMERALS

1 camshaft adjuster
2 stator
4 rotor
6 spring, coil spring
8 first recess
10 first free end
12 second recess
14 second free end
16 polygon
18 inner wall
20 spring winding
22 borehole
24 screw
26 cover
28 metal sheet
30 axial bulge
32 screw head or screw shank
34 axial extension element
36 inner cover, sealing cover
38 outer cover, spring recess cover
40 cutout
42 elevated element
44 upwardly bent element
46 free punched out portion
48 ring
50 partial segment
52 cut-out element
54 leg
R pulling direction
α angle

What is claimed is:

1. A camshaft adjuster comprising:

a stator and a rotor;

a spring rotatably bracing the rotor against the stator, the spring being a coil spring, the stator having a first recess for a first free end of the coil spring, the rotor having a second recess for a second free end of the coil spring; and a cover fixed to the stator, the cover being a flat disc including an inner circumference, an outer circumference and a flat radially extending surface facing away from the rotor and extending from the inner circumference to the outer circumference, the first free end of the coil spring being sandwiched between the flat radially extending surface and a further part, the further part axially restraining the first free end of the coil spring, wherein the further part is a metal sheet mounted on the stator via at least one screw passing through the metal sheet and the cover, the metal sheet having an axial bulge defining the first recess, the first free end of the coil spring resting in the axial bulge.

2. The camshaft adjuster as recited in claim 1 wherein a polygon forms the second recess at an inner wall of the rotor, a correspondingly shaped spring winding of the second free end of the coil spring cooperating with the polygon in a form-fit manner.

3. The camshaft adjuster as recited in claim 1 wherein a borehole forms the second recess at an angle less than or equal to 90° with respect to a pulling direction of the coil spring in the rotor, the second free end of the coil spring being introduced into the borehole.

4. The camshaft adjuster as recited in claim 1 wherein the cover is mounted on the stator via at least one screw.

5. The camshaft adjuster as recited in claim 1 wherein the cover has a through-hole, the spring being insertable through the through-hole.

6. The camshaft adjuster as recited in claim 1 wherein the cover does not include an external collar.

7. A camshaft adjuster comprising:

a stator and a rotor;

a spring rotatably bracing the rotor against the stator, the spring being a coil spring, the stator having a first recess for a first free end of the coil spring, the rotor having a second recess for a second free end of the coil spring; and an inner cover fixed to the stator and an outer cover fixed on the inner cover, the inner cover being a sealing cover and the outer cover forming a spring recess cover defining the first recess, the first free end of the coil spring being suspended in the first recess axially outside of the inner cover, the outer cover contacting the first free end of the coil spring axially outside of the inner cover, wherein the spring recess cover includes a cutout, an elevated element, an upwardly bent element, or a free punched out portion forming the first recess that receives the first free end of the coil spring.

8. The camshaft adjuster as recited in claim 7 wherein the spring recess cover is a ring.

9. A camshaft adjuster comprising:

a stator and a rotor;

a spring rotatably bracing the rotor against the stator, the spring being a coil spring, the stator having a first recess for a first free end of the coil spring, the rotor having a second recess for a second free end of the coil spring; and an inner cover fixed to the stator and an outer cover fixed on the inner cover, the inner cover being a sealing cover and the outer cover forming a spring recess cover defining the first recess, the first free end of the coil spring being suspended in the first recess axially outside of the inner cover, the outer cover contacting the first free end of the coil spring axially outside of the inner cover, wherein the spring recess cover includes a cutout, an elevated element, an upwardly bent element, or a free punched out portion, wherein the spring recess cover is a partial ring segment.

* * * * *